US009186806B2

(12) United States Patent
Holcomb et al.

(10) Patent No.: US 9,186,806 B2
(45) Date of Patent: Nov. 17, 2015

(54) HANDHELD FOOD SLICER

(75) Inventors: David A. Holcomb, Seattle, WA (US); Matthew Krus, Seattle, WA (US)

(73) Assignee: Chef'n Corporation, Seattle, WA (US)

( * ) Notice: Subject to any disclaimer, the term of this patent is extended or adjusted under 35 U.S.C. 154(b) by 475 days.

(21) Appl. No.: 13/016,168

(22) Filed: Jan. 28, 2011

(65) Prior Publication Data

US 2011/0192036 A1 Aug. 11, 2011

Related U.S. Application Data

(60) Provisional application No. 61/303,419, filed on Feb. 11, 2010.

(51) Int. Cl.

| | |
|---|---|
| ***B26D 3/16*** | (2006.01) |
| ***B26B 13/06*** | (2006.01) |
| ***B26B 3/04*** | (2006.01) |
| ***B26B 29/06*** | (2006.01) |
| ***B26D 1/30*** | (2006.01) |
| *B26D 5/10* | (2006.01) |

(52) U.S. Cl.

CPC . *B26D 3/161* (2013.01); *B26B 3/04* (2013.01); *B26B 13/06* (2013.01); *B26B 29/06* (2013.01); *B26B 29/063* (2013.01); *B26D 1/30* (2013.01); *B26D 3/169* (2013.01); *B26D 5/10* (2013.01)

(58) Field of Classification Search

CPC ..... B26B 9/12; B26B 13/00; B26B 13/06; B26D 3/161

USPC ..... 30/114, 124, 173, 278, 279.2, 304, 117, 30/176, 226; 83/13, 599

See application file for complete search history.

(56) References Cited

U.S. PATENT DOCUMENTS

| | | | | | |
|---|---|---|---|---|---|
| 255,429 | A | * | 3/1882 | Hallock | 83/467.1 |
| 550,483 | A | | 11/1895 | Carrier | |
| 1,107,950 | A | * | 8/1914 | Holsen | 7/158 |
| 1,113,105 | A | * | 10/1914 | Deman | 30/113 |
| 1,177,098 | A | * | 3/1916 | Gay | 30/112 |
| 1,504,589 | A | * | 8/1924 | Wagner et al. | 30/112 |
| 2,006,023 | A | * | 6/1935 | Lange et al. | 424/195.16 |
| 2,288,385 | A | * | 6/1942 | Beard | 83/200 |
| 2,516,959 | A | * | 8/1950 | Coull | 30/253 |
| 2,527,735 | A | * | 10/1950 | Johnson | 30/226 |
| 2,826,355 | A | * | 3/1958 | Scott | 494/63 |
| 3,164,899 | A | * | 1/1965 | Raze | 30/92 |
| 3,883,953 | A | * | 5/1975 | Saullo et al. | 30/304 |
| 4,092,774 | A | * | 6/1978 | Watts | 30/92 |
| 4,158,914 | A | * | 6/1979 | Kurtz | 30/359 |
| 4,393,588 | A | * | 7/1983 | Kowalski | 30/196 |

(Continued)

*Primary Examiner* — Kenneth E Peterson

(74) *Attorney, Agent, or Firm* — Seed IP Law Group PLLC

(57) ABSTRACT

A handheld food slicer including a first handle having a plurality of elongated fingers, each finger separated from an adjacent finger by a blade receiving slot, a second handle movably coupled to the first handle and a plurality of blade members spaced to align with the blade receiving slots to mate with the fingers to collectively define a food receiving passageway when the first and the second handles are in an expanded configuration in which a distal end of the first handle is at least partially spaced apart from a distal end of the second handle, the fingers of the first handle configured to pass through the food receiving passageway adjacent the blade members as the first and the second handles move from the expanded configuration towards a compressed configuration in which the distal end of each of the first and the second handles is relatively closer to the other.

16 Claims, 6 Drawing Sheets

(56) References Cited

U.S. PATENT DOCUMENTS

| | | | | | |
|---|---|---|---|---|---|
| 4,644,650 | A | * | 2/1987 | Laux et al. | 30/250 |
| 4,742,616 | A | * | 5/1988 | Lippert | 30/124 |
| 4,976,029 | A | * | 12/1990 | Kennedy | 30/114 |
| 5,035,056 | A | | 7/1991 | Sheffield | 30/305 |
| 5,499,578 | A | | 3/1996 | Payne | 99/537 |
| 5,937,523 | A | * | 8/1999 | Van Keppel et al. | 30/112 |
| 6,123,001 | A | * | 9/2000 | Andrich | 83/13 |
| 7,266,894 | B1 | | 9/2007 | Hinckley | 30/302 |
| 7,346,986 | B2 | * | 3/2008 | Feith | 30/92 |
| 8,181,560 | B2 | * | 5/2012 | Hauser et al. | 83/858 |
| 2002/0020067 | A1 | | 2/2002 | Silver et al. | 30/226 |
| 2006/0230892 | A1 | * | 10/2006 | Osuna | 83/13 |
| 2007/0089299 | A1 | * | 4/2007 | Belaubre | 30/112 |

* cited by examiner

HANDHELD FOOD SLICER

BACKGROUND

1. Technical Field

This disclosure is related to kitchen and/or food preparation tools, and more particularly, to a handheld device for slicing a food item, such as a banana.

2. Description of the Related Art

In the culinary arts, efficiency and presentation are both crucial to preparation of food items. One preparation task that is time-consuming is slicing food items. Food items that are frequently sliced include fruits and vegetables, such as bananas and cucumbers. Conventional methods of slicing include, in the simplest form, using a knife. However, such methods are time-consuming and can produce uneven or irregular food slices. For example, in the case of a banana, a user must methodically slice the banana along a length thereof, resulting in wasted energy and typically inconsistent banana slices. Such elementary methods are cumbersome and time-consuming, and pose a risk of injury to a user.

Other existing devices that are more expedient to use include tools having ribs or blades that may be pressed onto food items, such as bananas or apples, to produce multiple slices simultaneously. Examples of such devices include those shown and described in U.S. Pat. Nos. 5,035,056 and 7,266,894. These types of devices generally require the food item to rest on a rigid work surface (e.g., a table or cutting board) so that a user can press the device through the food item against resistance provided by the work surface. Consequently, food is generally sliced remote from a location where it is ultimately used or from which it is consumed, thereby necessitating additional food handling that results in wasted time and energy. These devices are also difficult or cumbersome to handle and typically require that the device be operated with two hands.

BRIEF SUMMARY

The handheld food slicers described herein are particularly well suited for quickly and efficiently cutting food items into multiple slices and in a manner that allows for direct placement or depositing of the same at a location of interest, such as, for example, a prepared dish or a storage container.

According to one embodiment, a handheld food slicer may be summarized as including a first handle having a plurality of elongated fingers, each finger separated from an adjacent finger by a blade receiving slot; a second handle movably coupled to the first handle; and a plurality of blade members coupled to the second handle in spaced alignment with the blade receiving slots to mate with the fingers to collectively define a food receiving passageway when the first and the second handles are in an expanded configuration in which a distal end of the first handle is at least partially spaced apart from a distal end of the second handle, the fingers of the first handle configured to pass through the food receiving passageway adjacent the blade members as the first and the second handles move from the expanded configuration towards a compressed configuration in which the distal end of each of the first and the second handles is relatively closer to the other. The handheld food slicer may further include a spring to bias the first and the second handles toward the expanded configuration. A pivot pin may rotatably couple the second handle to the first handle. A curvilinear portion of each of the fingers of the first handle may cooperate with the blade members to collectively define the food receiving passageway. The food receiving passageway may be substantially cylindrical. The distal end of the second handle may be formed about a portion of each of the blade members to rigidly secure the blade members thereto. The blade members may be spaced equally along a central axis of the food receiving passageway or may be irregularly spaced along the central axis.

DETAILED DESCRIPTION

Figure 3:
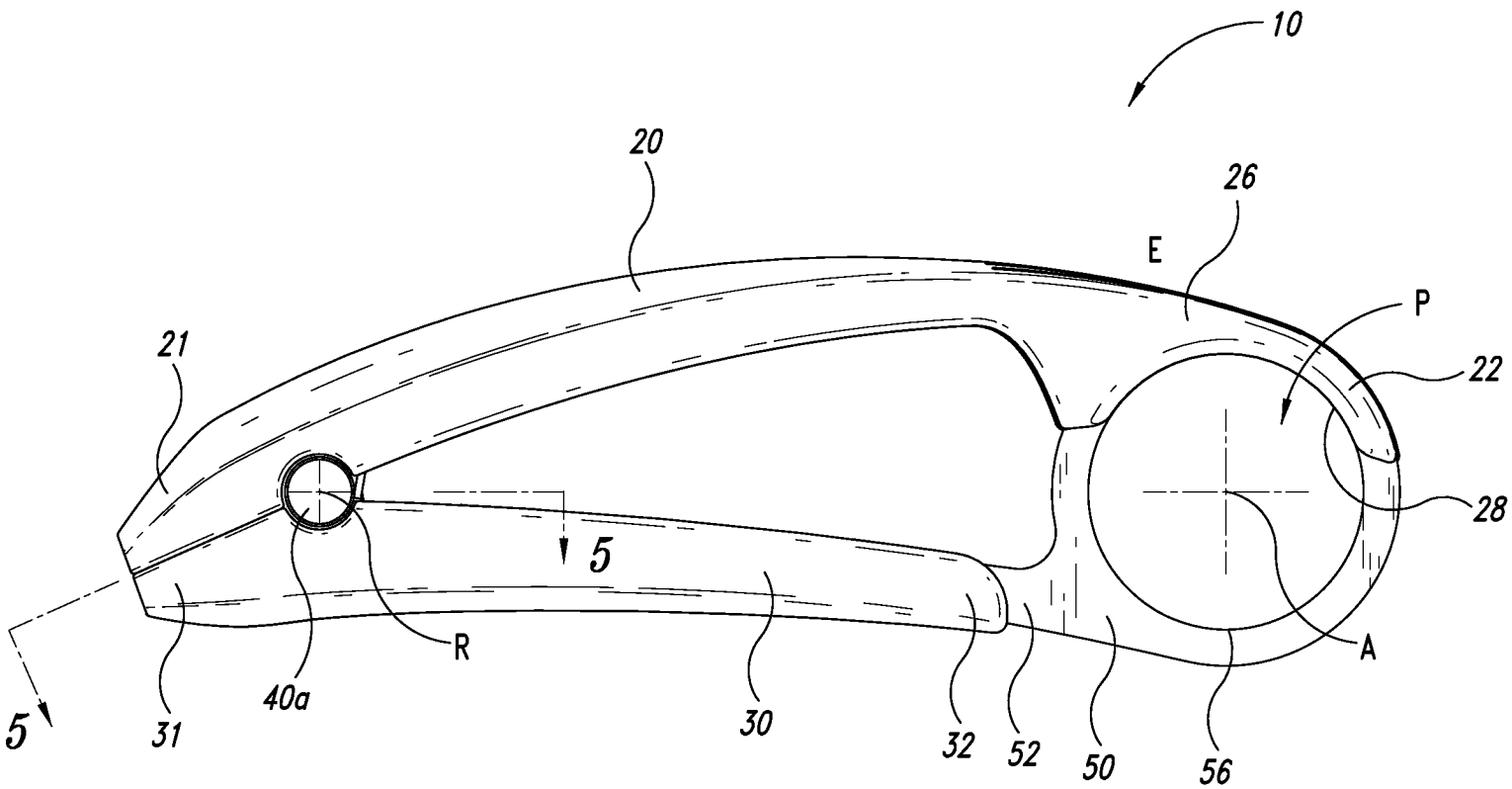
FIG. 3 is a side elevational view of the handheld food slicer of FIG. 1, shown in an expanded configuration.
Figure 4:
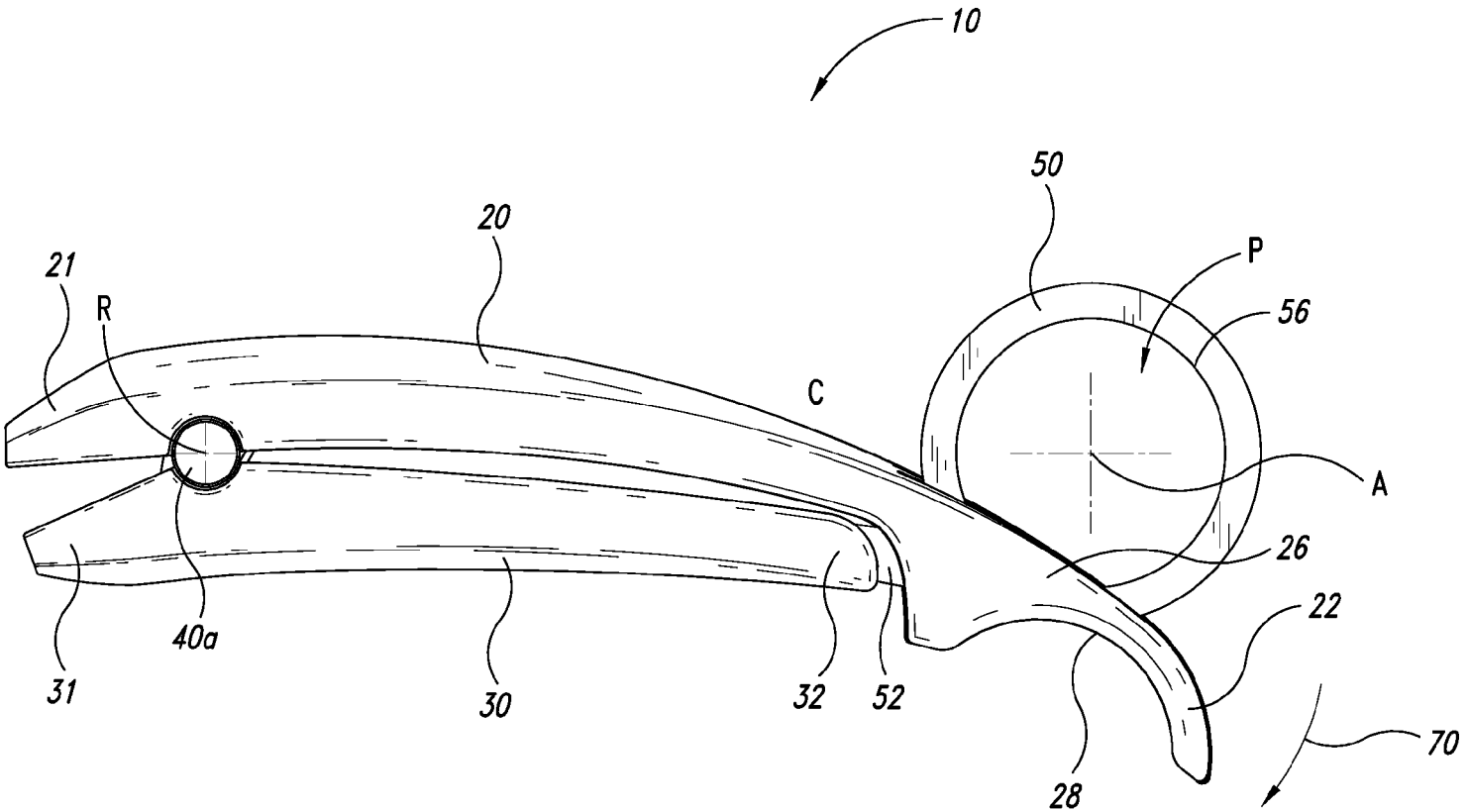
FIG. 4 is a side elevational view of the handheld food slicer of FIG. 1, shown in a compressed configuration.

FIGS. 1-5 illustrate a handheld food slicer 10 according to one embodiment which includes a first handle 20, a second handle 30 and blade members 50. The slicer 10 further includes a pivot pin 40 for rotatably coupling the first handle 20 and the second handle 30 together about a central rotation axis R. A spring 60 biases the handles 20, 30 away from each other such that the slicer 10 is urged towards a generally expanded configuration E (FIGS. 1 and 3) in which it is configured to insertably receive food items. A respective first end 21, 31 of the first and the second handles 20, 30 interoperate to limit the range of movement of the slicer 10 to the expanded configuration E. The slicer 10 is sized and its range of movement is limited such that it may fit comfortably in the grasp of an average sized hand throughout operation. A user may effortlessly grasp the slicer 10 in one hand and apply a force or pressure to overcome the bias of the spring 60 and transition the slicer 10 from the expanded configuration E to a compressed configuration C (FIG. 4). When the user relieves pressure from the handles 20, 30, the spring 60 urges the handles 20, 30 back toward the expanded configuration E. In this manner, the slicer 10 is selectively and repeatably movable between the expanded configuration E and the compressed configuration C by the intermittent application of force or pressure (i.e., by squeezing and releasing the handles 20, 30).

Each of the handles 20, 30 is generally elongated and includes the respective first end 21, 31 and a respective second end 22, 32 (also referred to as a distal end). A connection structure is located proximate the first end 21 of the first handle 20 for coupling or mating the first handle 20 to the second handle 30. As illustrated, the connection structure may take the form of upstanding lugs 23 having pivot apertures 24 sized to receive the pivot pin 40. The pivot pin 40 may comprise, for example, a multi-part structure including complementary threaded pin members 40*a*, 40*b*. The lugs 23 may be spaced apart at a distance sufficient to receive the spring 60 therebetween. The spring 60 may be a helical torsion spring, a compression spring or the like.

Figure 5:
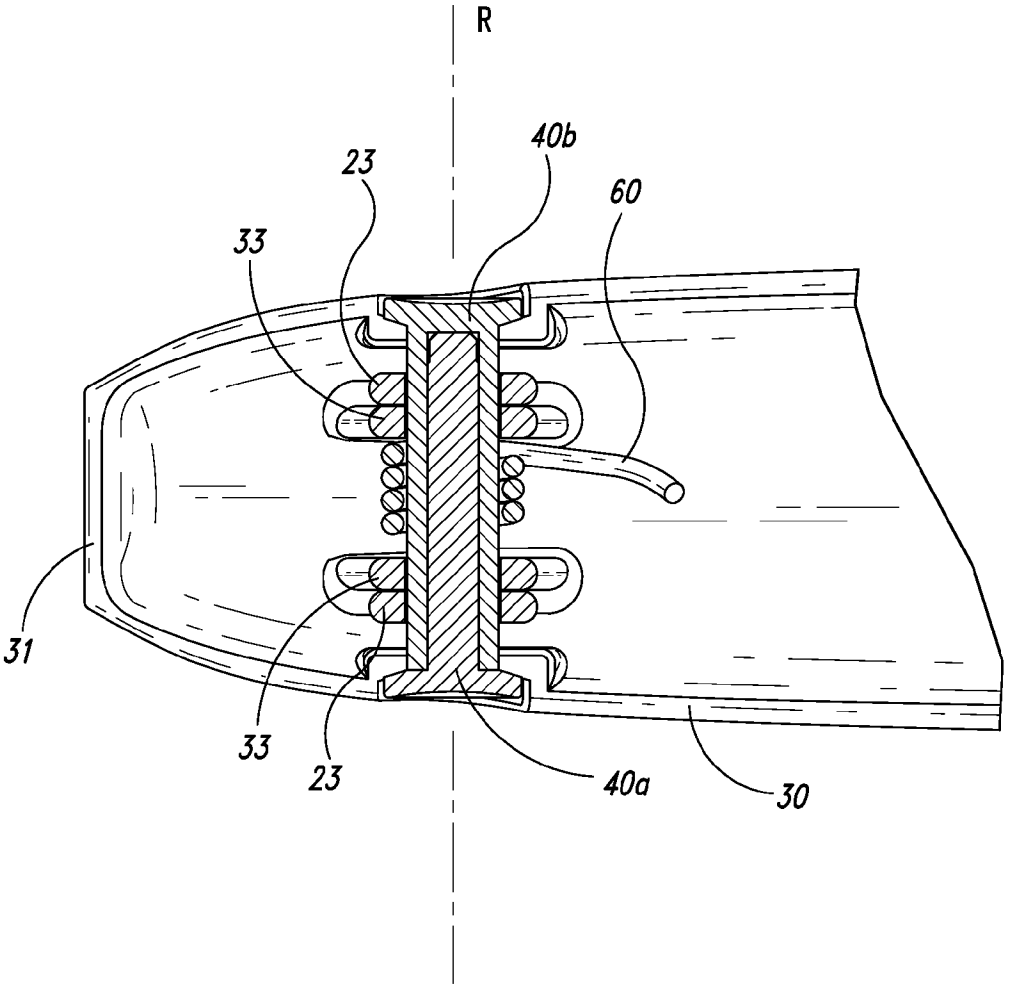
FIG. 5 is a partial cross-sectional view of taken along line 5-5 of FIG. 3.

A connection structure is similarly located proximate the first end 31 of the second handle 30. The connection structure of the second handle 30 may likewise take the form of upstanding lugs 33 having pivot apertures 34 sized to receive the pivot pin 40. The lugs 33 of the second handle 30 may be positioned to fit between the lugs 23 of the first handle 20, as illustrated in FIG. 5, or in alternate embodiments, may be positioned to fall outside the lugs 23 of the first handle 20. Further, although each of the handles 20, 30 is illustrated as including two separate lugs 23, 33, either handle 20, 30 may include a single centrally located lug configured to be received between a pair of lugs of the opposing handle. In such an embodiment, two axially offset springs may be utilized instead of a single centrally located spring 60.

A plurality of elongated fingers 26 are located at the second end 22 of the first handle 20. The fingers 26 are separated from each other by blade receiving slots 27. The blade receiving slots 27 have a width approximately equal to a corresponding blade member 50 coupled to the second end 32 of the second handle 30. Although the illustrated embodiment includes seven separate elongated fingers 26, in other embodiments, the handheld food slicer 10 may include more or fewer fingers 26. In addition, a width of the fingers 26 may vary in accordance with a desired width of sliced food items. For example, thinner fingers 26 may be provided for applications in which thinly sliced food items are desired. Conversely, wider fingers 26 may be provided for applications in which thicker sliced food items are desired.

The fingers 26 may extend seamlessly from a base of the first handle 20 such that an outer surface of the first handle 20 appears uninterrupted. The second handle 30 may also include a contoured outer surface that likewise appears uninterrupted and which may be complementarily shaped with respect to the first handle 20. In some embodiments, the outer surface of the handles 20, 30 may be complementarily shaped to reflect a food item for which the slicer 10 is particularly adapted to slice. For instance, a slicer 10 particularly adapted to receive and slice bananas may include handles 20, 30 having outer surfaces that reflect part of a banana, as illustrated in FIG. 3. Other examples include a carrot shaped slicer for slicing carrots, a celery shaped slicer for slicing celery and a cucumber shaped slicer for slicing cucumbers.

As indicated above, blade members 50 are coupled to the second end 32 of the second handle 30. The blade members 50 are spaced along a central axis A to align with the blade receiving slots 27 of the first handle 20. The blade members 50 and hence blade receiving slots 27 may be spaced in equal intervals, as illustrated, or in alternate embodiments may be irregularly spaced. Each of the blade members 50 includes a blade edge profile 56 that generally corresponds to the shape of a food item to be sliced. For example, each blade member 50 may include an arcuate or a circular blade edge profile 56 corresponding to a shape of a food item having a generally circular cross-sectional profile, such as, for example, a banana. The blade members 50 and fingers 26 are positioned to collectively define a food receiving passageway P that extends generally transverse to a length of the elongated handles 20, 30.

Figure 1:
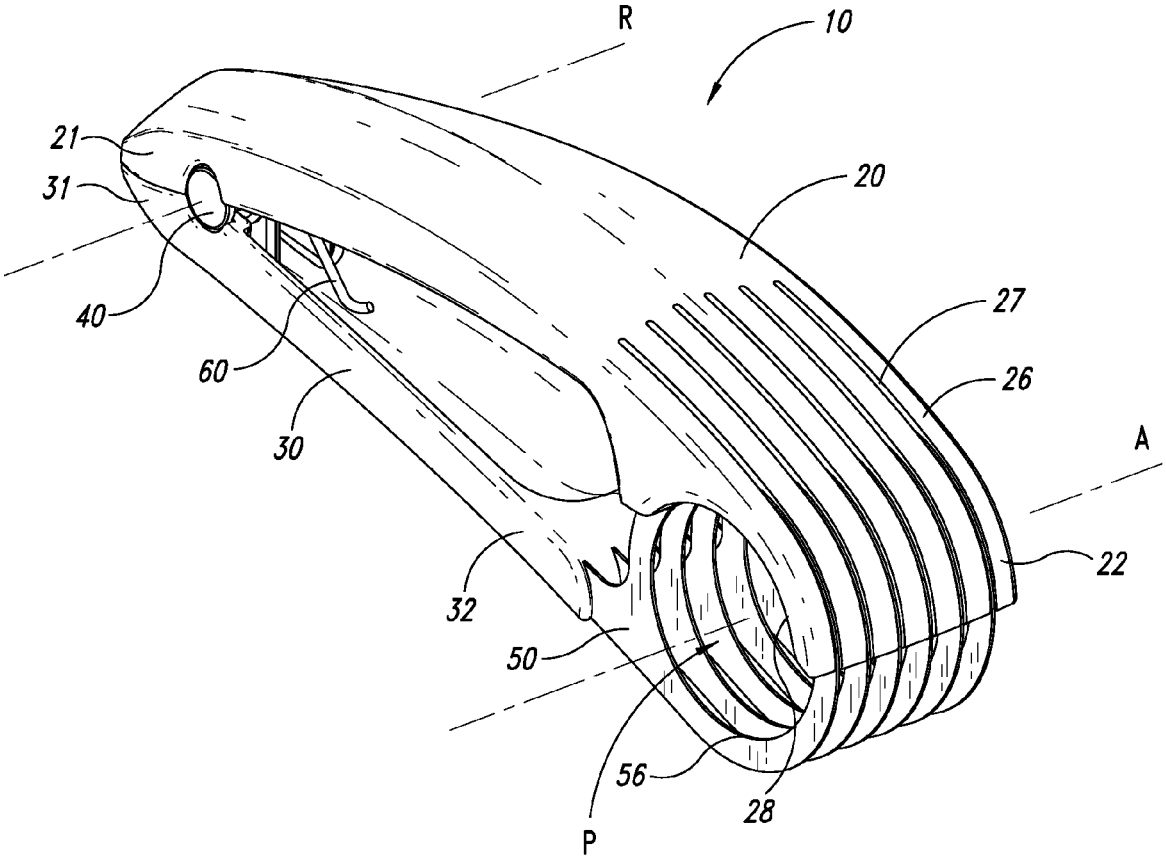
FIG. 1 is an isometric view of a handheld food slicer according to one embodiment, shown in an expanded configuration.
Figure 2:
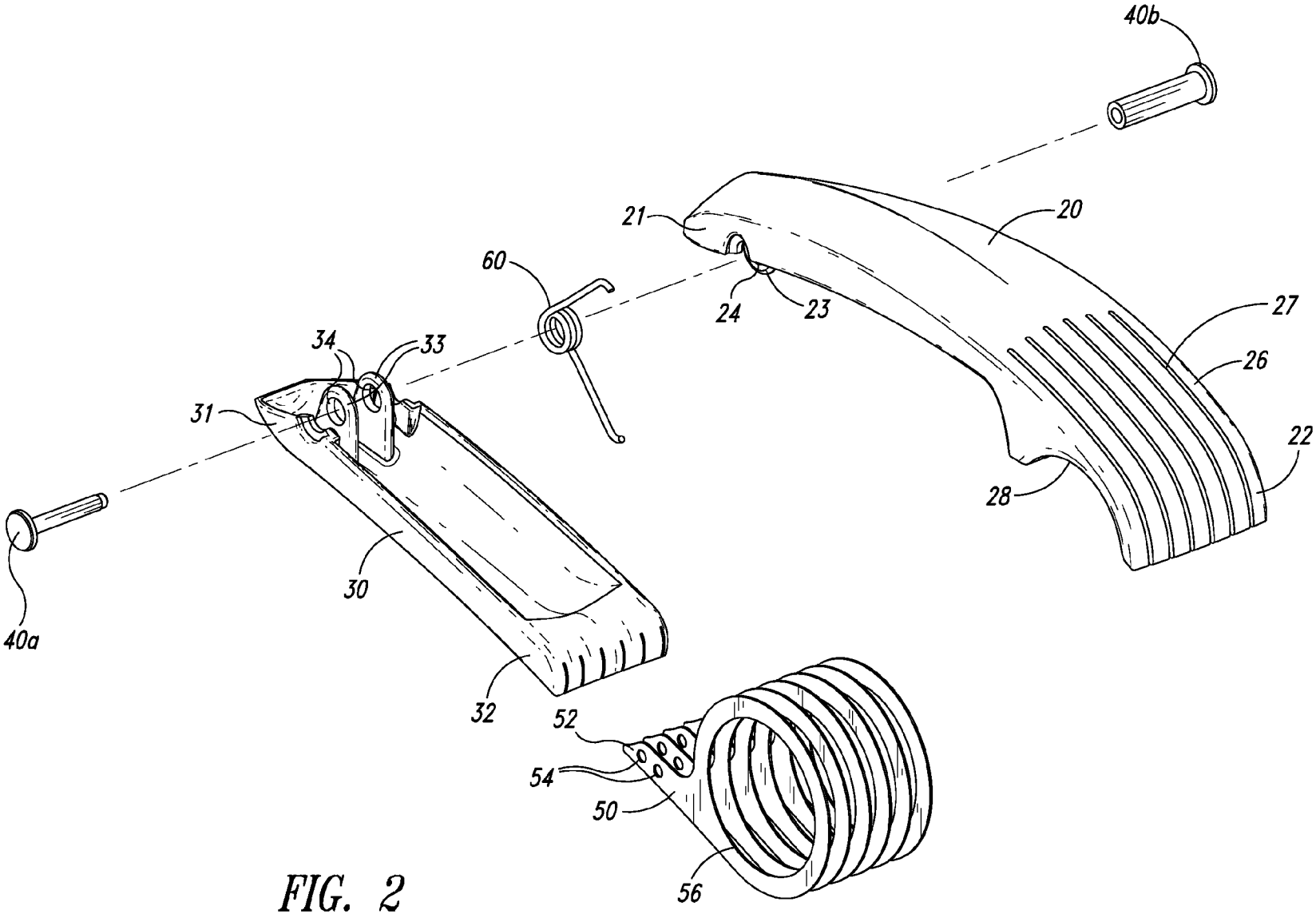
FIG. 2 is an exploded isometric view of the handheld food slicer of FIG. 1.
Figure 6A:
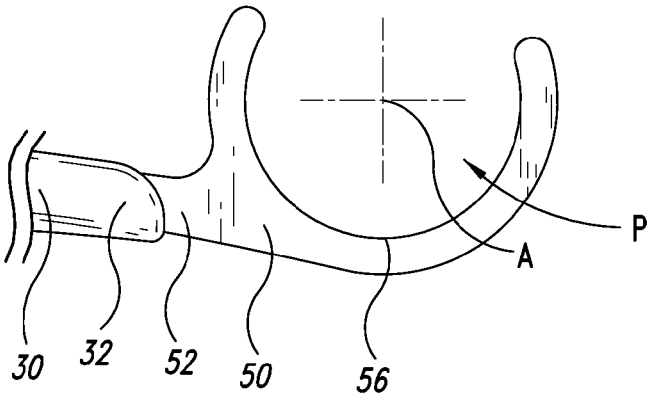
FIG. 6A is a partial side elevational view of a handheld food slicer according to another embodiment, shown with a handle removed.
Figure 6B:
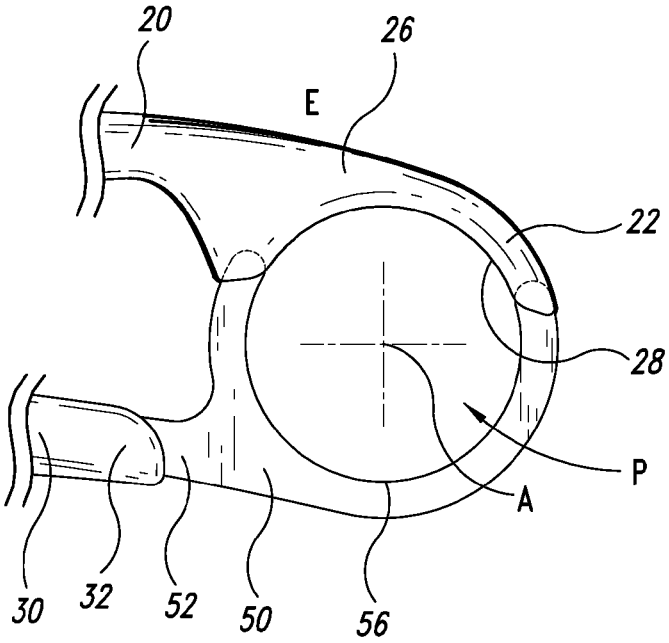
FIG. 6B is a partial side elevational view of the handheld food slicer of FIG. 6A, shown in an expanded configuration.
Figure 6C:
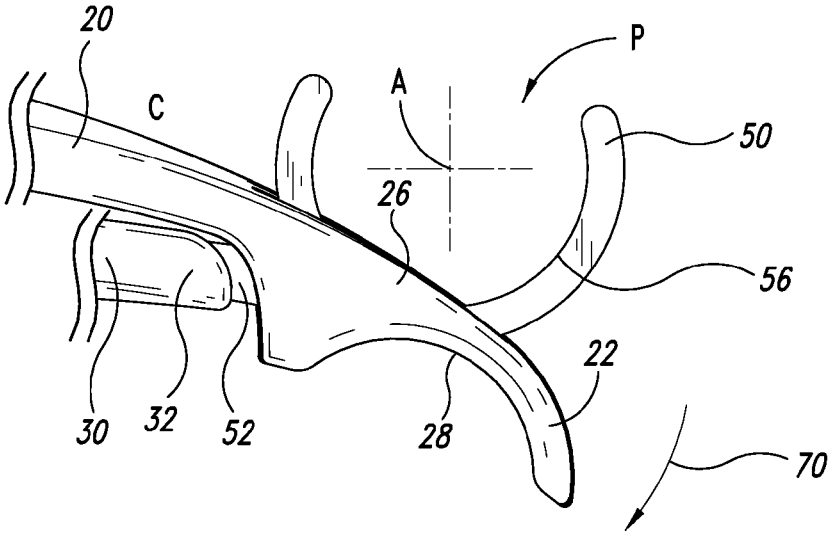
FIG. 6C is a partial side elevational view of the handheld food slicer of FIG. 6A, shown in a compressed configuration.

In some embodiments, the blade edge profiles 56 may comprise closed profiles, such as complete circular or elliptical profiles. In other embodiments, the blade edge profiles 56 may comprise open profiles. For example, the embodiment illustrated in FIGS. 6A-6C has blade members 50 each including a u-shaped blade edge profile 56 which is bridged or capped by a portion 28 of a respective finger 26 of the first handle 20 to form the food receiving passageway P. In this manner, a portion 28 of the fingers 26 may cooperate with the blade members 50 to collectively define the food receiving passageway P. As another example, as illustrated in FIGS. 1 and 3, a curvilinear portion 28 of the fingers 26 of the first handle 20 cooperates with the blade members 50 to collectively define a substantially cylindrical food receiving passageway P extending along central axis A.

Each blade member 50 further includes a structure for coupling to the second handle 30. This structure may comprise, for example, a protruding portion 52 adapted to be received by or otherwise coupled to the second handle 30. The blade members 50 may be attached to the second handle 30 by clips, snaps, detents or other fastening structures or may be formed integrally therewith. For example, the second handle 30 may be formed around the protruding portion 52 of each blade member 50 via a molding process. The blade members 50 may further include one or more apertures 54 for receiving material of the second handle 30 during a molding process to facilitate secure attachment.

Operation of the handheld food slicer 10 is further discussed with particular reference to FIGS. 3 and 4. As illustrated in FIG. 3, the food slicer 10 is configured to be held initially in an expanded configuration E. In the expanded configuration E, the second end 22 (or distal end) of the first handle 20 and the second end 32 (or distal end) of the second handle 30 are spaced apart under the bias of spring 60 such that the fingers 26 of the first handle 20 are positioned to one side of the food receiving passageway P. Further, the blade members 50 align with and at least partially engage the blade receiving slots 27 between the fingers 26. In this expanded configuration E, food items may be inserted in the food receiving passageway P for subsequent slicing. More particularly, a user may grasp the slicer 10 with one hand and a food item with the other. The user may then insert the food item into the receiving passageway P and position the slicer 10 with the food item therein in various orientations prior to slicing. For example, a user may insert a banana into the food receiving passageway P and position the slicer 10 over a bowl of cereal for subsequent placement of sliced banana pieces in the bowl directly.

With reference to FIG. 4, the handheld food slicer 10 is transitionable from the expanded configuration E to a compressed configuration C, as indicated by the arrow labeled 70. The slicer 10 may be moved to the compressed configuration C by grasping the slicer 10 in the palm of one's hand and squeezing the handles 20, 30 to overcome the bias of the spring 60 and bring the second ends 22, 32 (or distal ends) of the handles 20, 30 relatively closer together. The spring 60 may be sized and/or shaped such that the spring bias is easily overcome by a moderate squeezing action. In this manner, the slicer 10 is particularly well suited for one-handed operation.

As the slicer 10 transitions to the compressed configuration C, the fingers 26 of the first handle 20 pass through the food receiving passageway P adjacent the blade members 50. As such, when a food item is in the passageway P, the fingers 26 push the food item into engagement with the blade edge profile 56 of each blade member 50. As the fingers 26 move through the passageway P, the blade members 50 penetrate the food item and cut the same into sliced pieces. As discussed above, the slicer 10 may be manipulated during the slicing process to various orientations. Accordingly, a user can selectively place sliced food products into storage containers or onto prepared dishes, for example, without additional handling. The slicer 10 thus provides a particularly versatile food slicing mechanism.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A handheld food slicer configured to insertably receive an elongated food item in a transverse direction and slice the elongated food item into a plurality of uniform discs, the handheld food slicer comprising:

a first handle having a plurality of elongated fingers, each finger having a finger width and being separated from an adjacent finger by a thin blade receiving slot, each thin blade receiving slot having a slot width that is a fraction of the finger width;

a second handle movably coupled to the first handle and including at least three blade members, each blade member having a blade width to fit within a respective one of the thin blade receiving slots and having a closed profile defining an aperture to insertably receive the elongated food item; and a spring to bias the first and the second handles toward a fully expanded configuration in which a distal end of the first handle is at least partially spaced apart from a distal end of the second handle;

wherein the at least three blade members of the second handle are in spaced alignment with the thin blade receiving slots of the first handle, wherein, when the first and the second handles are biased apart by the spring in the fully expanded configuration, a distal end of the elongated fingers of the first handle overlap with the blade members of the second handle when viewing the handheld food slicer in the transverse direction to collectively define a food receiving passageway for insertably receiving the elongated food item in the transverse direction, and wherein the elongated fingers of the first handle are configured to pass through the food receiving passageway adjacent the blade members to simultaneously slice the elongated food item into the plurality of uniform discs having a width equal to the finger width as the first and the second handles move against the bias of the spring from the fully expanded configuration towards a compressed configuration in which the distal end of each of the first and the second handles is relatively closer to the other.

2. The handheld food slicer of claim 1 wherein the spring is configured to hold the first and the second handles in the fully expanded configuration when the handheld food slicer is not acted upon by an outside force.

3. The handheld food slicer of claim 1, further comprising:

a pivot pin to rotatably couple the second handle to the first handle.

4. The handheld food slicer of claim 1 wherein the food receiving passageway collectively defined by the fingers and the blade members when the first and the second handles are biased apart by the spring in the fully expanded configuration is substantially cylindrical.

5. The handheld food slicer of claim 1 wherein, when viewing the handheld food slicer in the transverse direction, a curvilinear portion of each of the elongated fingers aligns with an interior profile of the blade members to collectively define the food receiving passageway.

6. The handheld food slicer of claim 1 wherein the second handle includes a handle member coupled to the at least three blade members, and wherein a distal end of the handle member is formed about a portion of each of the blade members to rigidly secure the blade members thereto.

7. The handheld food slicer of claim 1 wherein the blade members are spaced equally along a central axis of the food receiving passageway.

8. The handheld food slicer of claim 1 wherein the food receiving passageway collectively defined by the fingers and the blade members when the first and the second handles are biased apart by the spring in the fully expanded configuration extends in the transverse direction which is perpendicular to a longitudinal length of the handheld food slicer.

9. The handheld food slicer of claim 1 wherein the plurality of elongated fingers of the first handle project from the distal end thereof in a direction generally aligned with a longitudinal length of the first handle.

10. The handheld food slicer of claim 1 wherein the first and the second handles are positioned relative to each other such that squeezing the first and the second handles together forces the fingers of the first handle to pass through the food receiving passageway adjacent the blade members.

11. The handheld food slicer of claim 1 wherein, when the first and the second handles are biased apart by the spring in the fully expanded configuration, the food receiving passageway has a closed profile when viewing the handheld food slicer in the transverse direction.

12. A device for use in insertably receiving an elongated food item in a transverse direction and slicing the elongated food item into a plurality of uniform discs, the device comprising:

a first handle portion having a proximal end and an opposing distal end, the distal end of the first handle portion having a plurality of elongated fingers projecting therefrom, each finger separated from one or more adjacent fingers by a blade receiving slot having a slot width that is a fraction of a finger width;

a second handle portion having a proximal portion and an opposing distal portion, the proximal portion of the second handle portion being movably coupled to the proximal end of the first handle portion, the first and second handle portions adapted to be held in one hand with one portion nested in a palm and the other portion held by a plurality of fingers;

a spring to bias the first and the second handle portions toward a fully expanded configuration in which a distal end of the first handle portion is at least partially spaced apart from a distal end of the second handle portion; and at least three blade members provided at the distal end of the second handle portion in spaced alignment with the blade receiving slots in the first handle portion to mate with the fingers, each blade member having a closed profile defining to insertably receive the elongated food item, and wherein, when the first and the second handle portions are biased apart by the spring in the fully expanded configuration, a distal end of the fingers and the blade members overlap when viewing the device in the transverse direction to collectively define a food receiving passageway for insertably receiving the elongated food item in the transverse direction, the fingers of the first handle portion configured to pass through the food receiving passageway adjacent the blade members as the first and the second handle portions are moved against the bias of the spring from the fully expanded configuration towards a compressed configuration in which the distal end of each of the first and the second handle portions is relatively closer to the other.

13. The device of claim 12 wherein the food receiving passageway defined by the combination of the fingers and the blade members when the first and the second handle portions are biased apart by the spring in the fully expanded configuration extends in the transverse direction which is perpendicular to a longitudinal length of the device.

14. The device of claim 12 wherein the plurality of elongated fingers that project from the distal end of the first handle portion project in a direction generally aligned with a longitudinal length of the first handle portion.

15. The device of claim 12 wherein the first and the second handle portions are configured relative to each other such that squeezing the first and the second handle portions together forces the fingers of the first handle portion to pass through the food receiving passageway adjacent the blade members.

16. The device of claim 12 wherein, when the first and the second handle portions are biased apart by the spring in the fully expanded configuration, the food receiving passageway has a closed profile when viewing the device in the transverse direction.

* * * * *